US008395560B2

(12) United States Patent
Lin et al.

(10) Patent No.: US 8,395,560 B2
(45) Date of Patent: Mar. 12, 2013

(54) SATELLITE ANTENNA DEVICE

(75) Inventors: Yi-Chieh Lin, Taipei Hsien (TW); Hung-Yuan Lin, Taipei Hsien (TW); San-Yi Kuo, Taipei Hsien (TW)

(73) Assignee: Wistron NeWeb Corp., Hsinchu (TW)

( * ) Notice: Subject to any disclaimer, the term of this patent is extended or adjusted under 35 U.S.C. 154(b) by 684 days.

(21) Appl. No.: 12/555,685

(22) Filed: Sep. 8, 2009

(65) Prior Publication Data

US 2010/0315310 A1 Dec. 16, 2010

(30) Foreign Application Priority Data

Jun. 12, 2009 (TW) ..... 98119676 A

(51) Int. Cl.
*H01Q 13/00* (2006.01)

(52) U.S. Cl. ..... 343/786

(58) Field of Classification Search ..... 343/772, 343/783, 785, 786
See application file for complete search history.

(56) References Cited

U.S. PATENT DOCUMENTS 7,109,941 B2 * 9/2006 Nagano et al. ..... 343/786
2005/0140560 A1 * 6/2005 Nagano et al. ..... 343/786

* cited by examiner

*Primary Examiner* — Robert Karacsony

(57) ABSTRACT

A satellite antenna device is provided. The satellite antenna device includes a body, a wave guide, and a dielectric member. The wave guide is connected to the body. The dielectric member is connected to the wave guide, wherein the dielectric member comprises a first portion and a second portion, the first portion has a protruding structure, the protruding structure is formed surrounding a central axis of the wave guide, the second portion has a concave structure, and the concave structure corresponds to the protruding structure, and is matched therewith.

1 Claim, 16 Drawing Sheets

1

SATELLITE ANTENNA DEVICE

CROSS REFERENCE TO RELATED APPLICATIONS

This Application claims priority of Taiwan Patent Application No. 98119676, filed on Jun. 12, 2009, the entirety of which is incorporated by reference herein.

BACKGROUND OF THE INVENTION

1. Field of the Invention

The present invention relates to a satellite antenna device, and in particular relates to a satellite antenna device for receiving satellite signals.

2. Description of the Related Art

FIG. 1*a* is a perspective view of a conventional satellite antenna device 1, and FIG. 1*b* is an exploded view of the conventional satellite antenna device 1. With reference to FIG. 1*b*, the conventional satellite antenna device 1 includes a body 10, a wave guide 20 and a dielectric member 30. The wave guide 20 is connected to the body 10. The dielectric member 30 is connected to the wave guide 20.

FIG. 1*c* is a cross-sectional view of conventional wave guide 20 and dielectric member 30. A conventional dielectric member 30 comprises a radiator body 31 and a waterproof cover 32. The waterproof cove 32 wedges an end of the wave guide 20. The radiator body 31 is received in the waterproof cover 32 and the wave guide 20. The radiator body 31 is formed by injection molding. However, air trap 33 is often formed in the radiator body 31, and deteriorates the performance of the dielectric member 30.

BRIEF SUMMARY OF THE INVENTION

A detailed description is given in the following embodiments with reference to the accompanying drawings.

A satellite antenna device is provided. The satellite antenna device includes a body, a wave guide, and a dielectric member. The wave guide is connected to the body. The dielectric member is connected to the wave guide, wherein the dielectric member comprises a first portion and a second portion, the first portion has a protruding structure, the protruding structure is formed surrounding a central axis of the wave guide, the second portion has a concave structure, and the concave structure corresponds to the protruding structure, and is matched therewith.

In the embodiment of the invention, the protruding structure matches the concave structure. Therefore, the material thickness of each portions of the dielectric member is substantially the same during injection molding. Accordingly the substantially same material thickness of each portion of the dielectric member prevents air trap from forming, and the performance of the dielectric member is improved.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
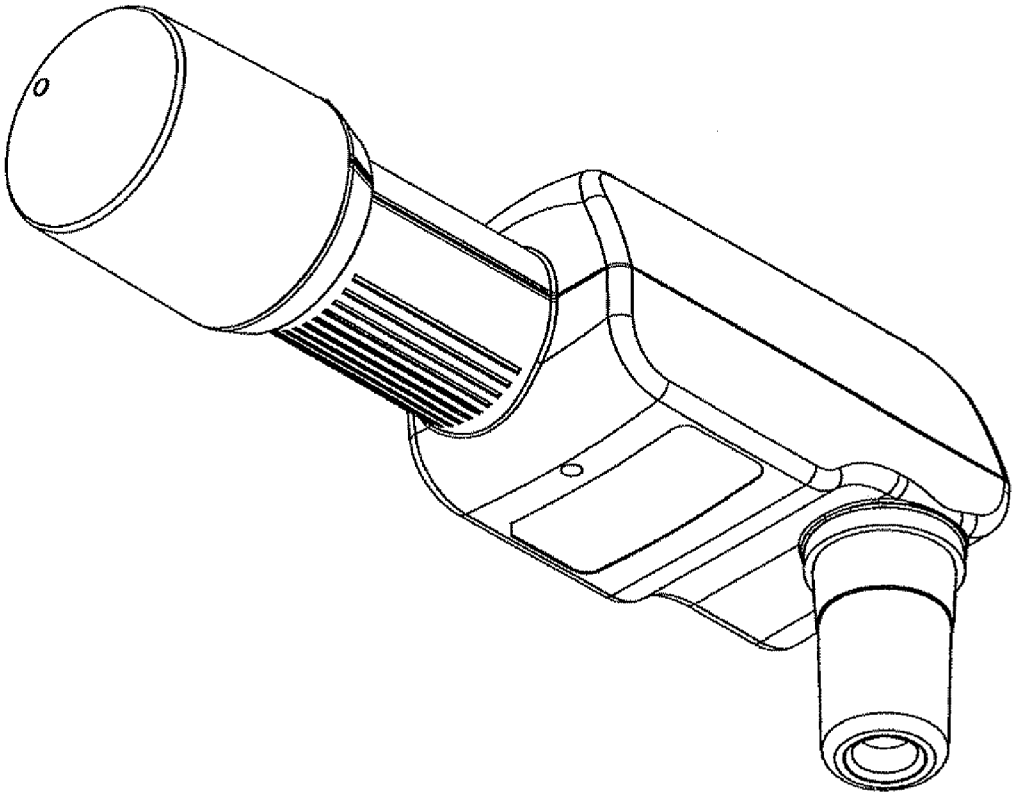
FIG. 1a ( PRIOR ART )
FIG. 1*a* is a perspective view of a conventional satellite antenna device.
Figure 1B:
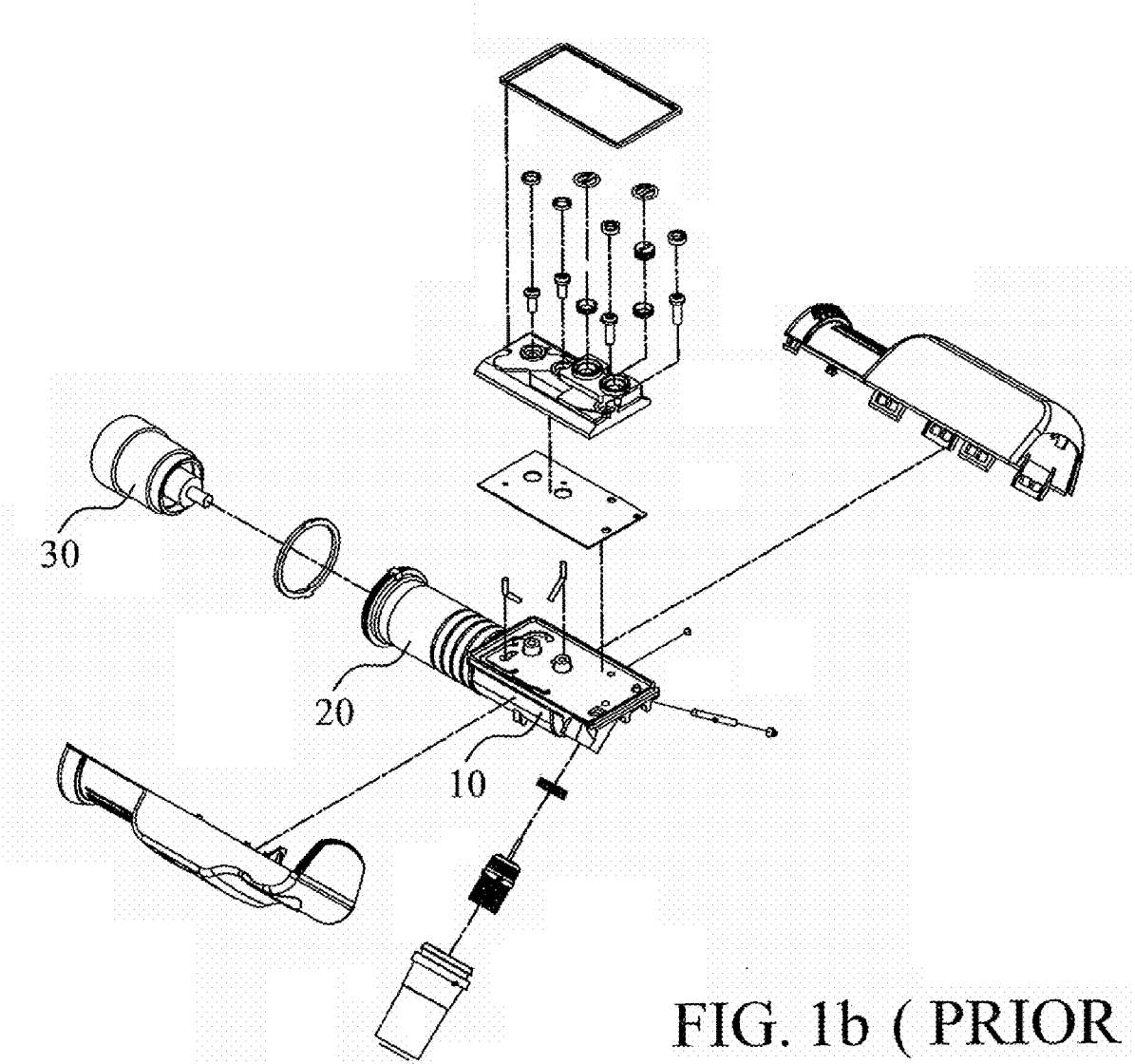
FIG. 1b ( PRIOR ART )
FIG. 1*b* is an exploded view of the conventional satellite antenna device.
Figure 1C:
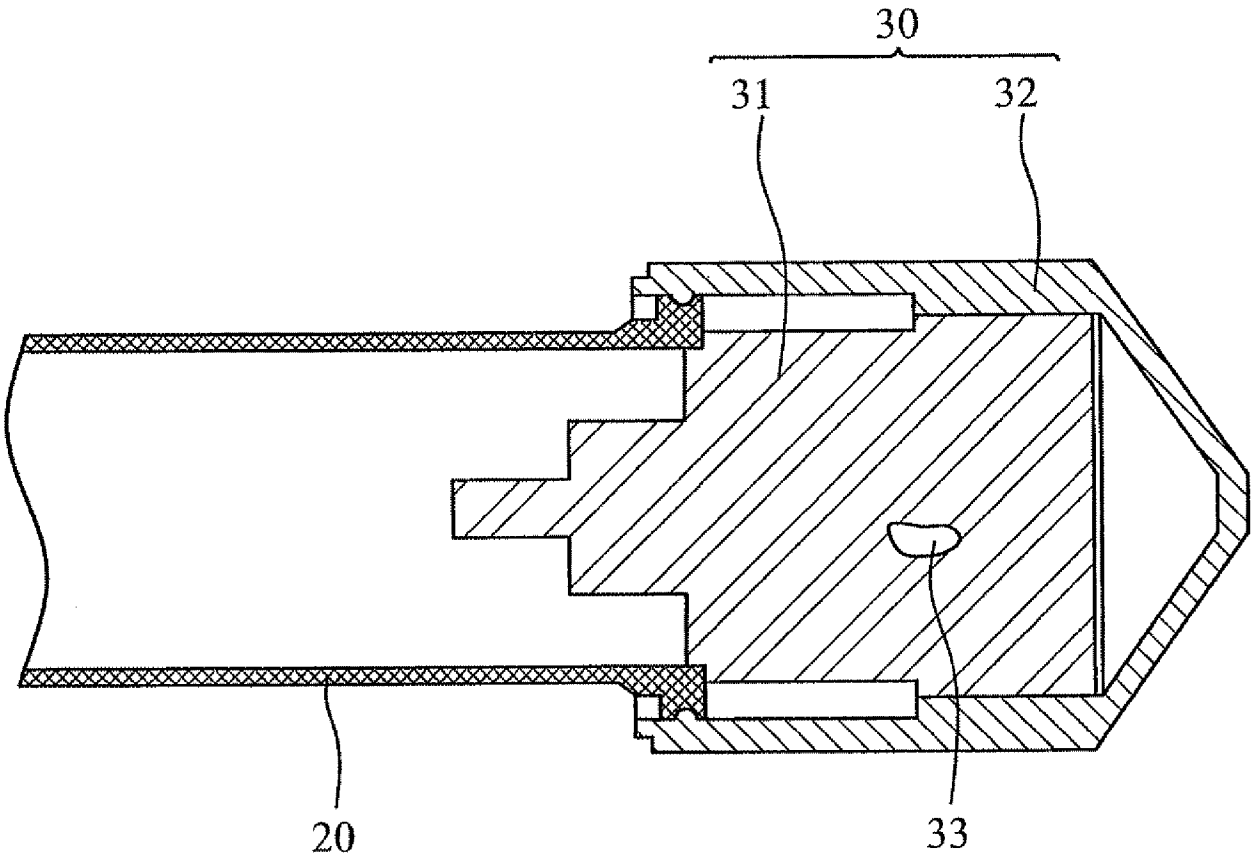
FIG. 1c ( PRIOR ART )
FIG. 1*c* is a cross-sectional view of conventional wave guide and dielectric member.
Figure 2A:
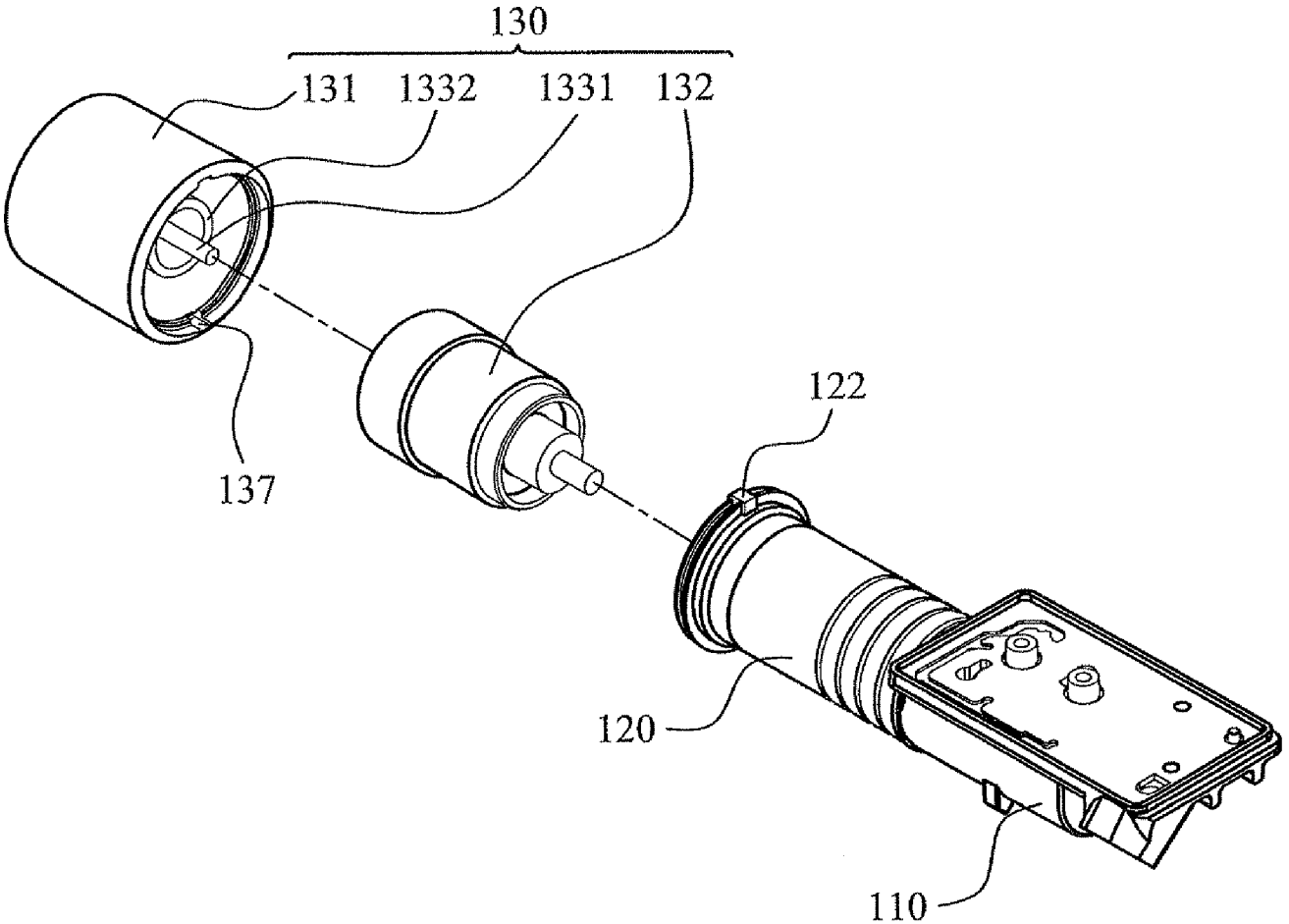
FIG. 2*a* shows a satellite antenna device of a first embodiment of the invention.

FIG. 2*a* shows a satellite antenna device 100 of a first embodiment of the invention, including a body 110, a wave guide 120 and a dielectric member 130. The wave guide 120 is connected to the body 110. The dielectric member 130 is connected to the wave guide 120.

Figure 2B:
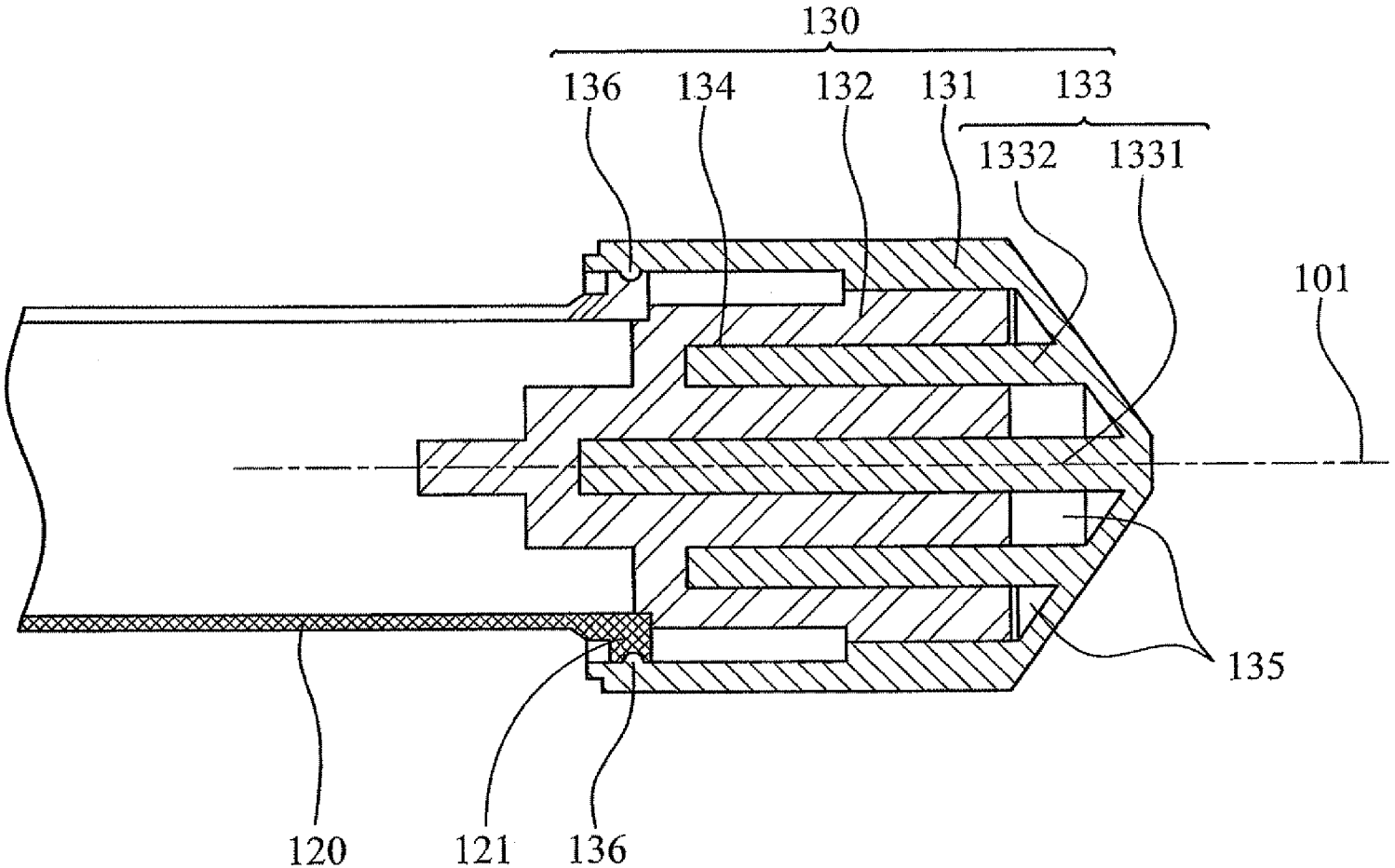
FIG. 2*b* is a cross-sectional view of the dielectric member and the wave guide.

FIG. 2*b* is a cross-sectional view of the dielectric member 130 and the wave guide 120. With reference to FIGS. 2*a* and 2*b*, the dielectric member 130 is substantially a pillar, including a first portion 131 and a second portion 132. The first portion 131 has a first protruding structure 133. The first protruding structure 133 is formed surrounding a central axis 101 of the wave guide 120. The second portion 132 has a concave structure 134. The concave structure 134 corresponds to the protruding structure 133, and is matched therewith.

In this embodiment, the protruding structure 133 includes a pillar 1331 and an annular structure 1332. The pillar 1331 is located on the central axis 101. The annular structure 1332 surrounds the pillar 1331.

In the embodiment of the invention, the protruding structure 133 matches the concave structure 134. Therefore, the material thickness of each portion of the dielectric member 130 is substantially the same during injection molding. Accordingly the substantially same material thickness of each portion of the dielectric member 130 prevents air trap from forming, and the performance of the dielectric member 130 is improved.

With reference to FIG. 2*b*, gaps 135 are formed between a front end of the second portion 132 and the first portion 131. When the gaps 135 are formed symmetric to the central axis 101, the performance of the dielectric member is not influenced. In other embodiment, the gaps 135 are infilled by sealant material.

The first portion 131 further includes a first wedging structure 136, and the first wedging structure 136 is formed on an inner wall of the first portion 131. The wave guide 120 further includes a second wedging structure 121, and the second wedging structure 121 is formed on an end of the wave guide 120. The first wedging structure 136 wedges the second wedging structure 121. In this embodiment, the dielectric member 130 does not need an additional waterproof cover to repel water.

With reference to FIG. 2*a*, the first portion 131 further has positioning structures 137, the wave guide 120 further has positioning structures 122, the positioning structures 137 match the positioning structures 122 to prevent the dielectric member 130 from being twisted relative to the wave guide 120 and separated therefrom.

Figure 3A:
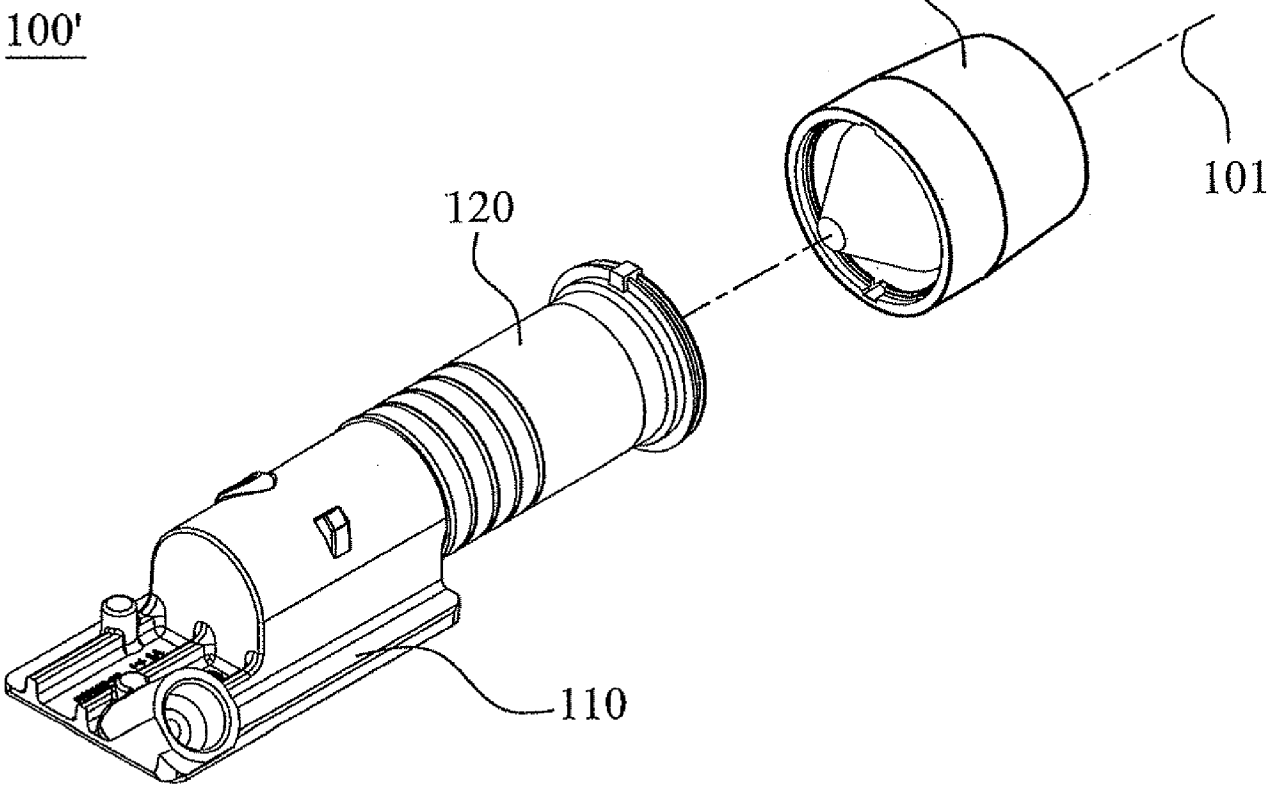
FIGS. 3*a* and 3*b* show a satellite antenna device of a second embodiment of the invention.
Figure 3B:
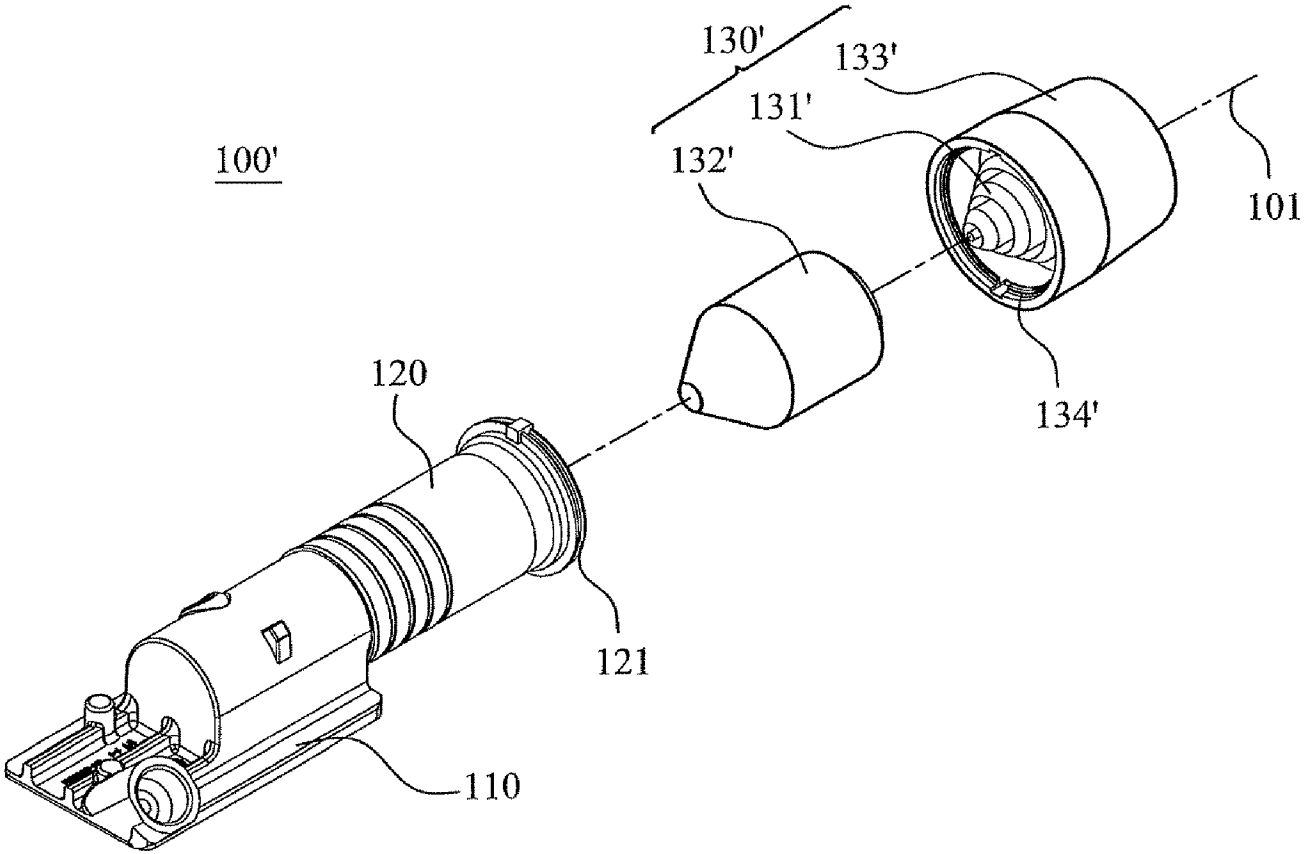

FIGS. 3*a* and 3*b* show a satellite antenna device 100' of a second embodiment of the invention, including a body 110, a wave guide 120 and a dielectric member 130'. The wave guide 120 is connected to the body 110. The dielectric member 130' is connected to the wave guide 120.

The dielectric member 130' is substantially a pillar, including a first portion 131', a second portion 132' and a cover 133'. The first portion 131' has a first protruding structure. The first protruding structure is formed surrounding a central axis 101 of the wave guide 120. The second portion 132' has a concave structure. The concave structure corresponds to the protruding structure, and is matched therewith. The first portion 131' and the second portion 132' are received in the cover 133'. The cover 133' has a first wedging structure 134', and the first wedging structure 134' is formed on an inner wall of the cover 133'. The wave guide 120 further includes a second wedging structure 121, and the second wedging structure 121 is formed on an end of the wave guide 120. The first wedging structure 134' wedges the second wedging structure 121.

Figure 4A:
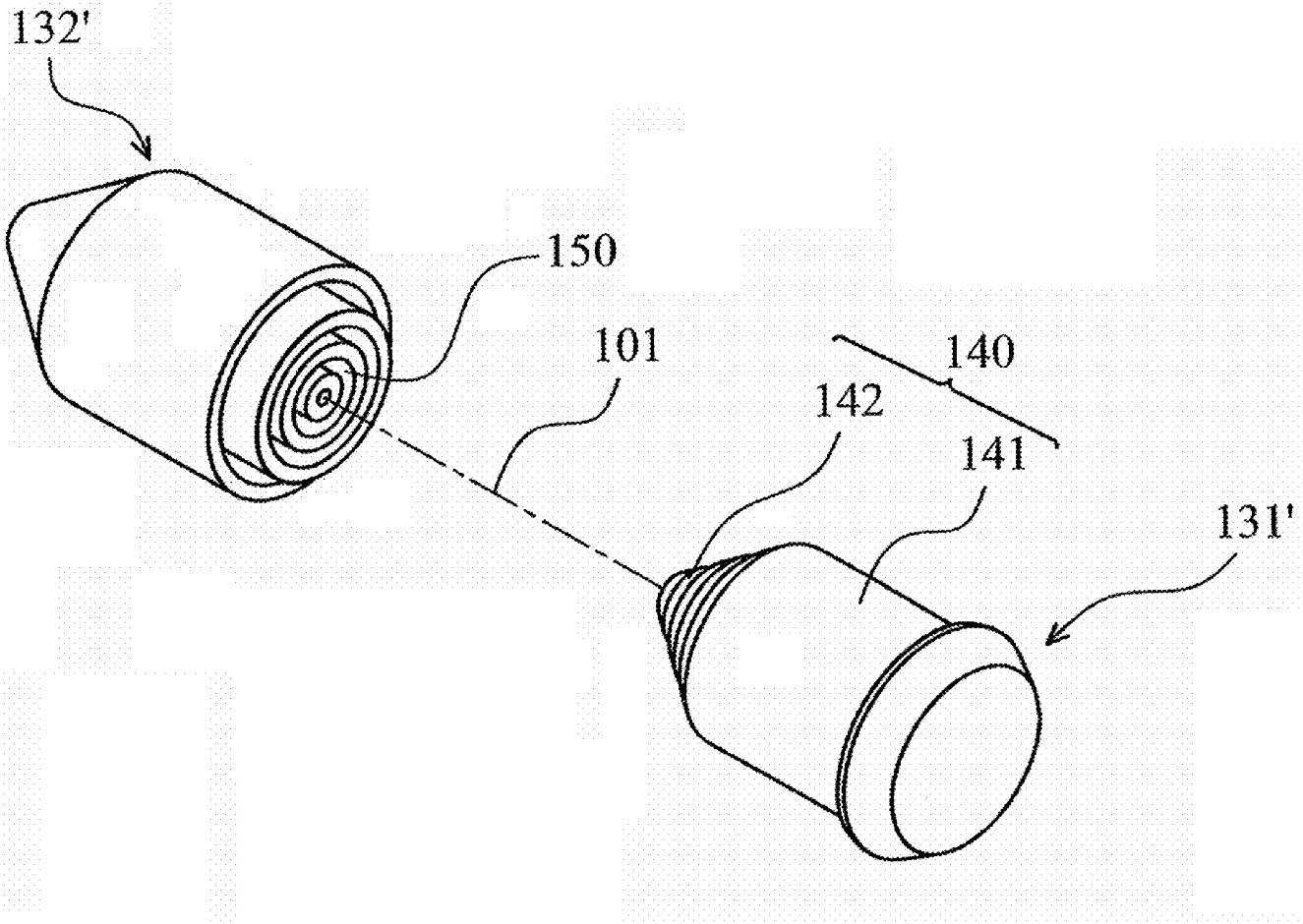
FIG. 4*a* shows a detailed structure of the first portion and the second portion of the second embodiment of the invention.

FIG. 4*a* shows a detailed structure of the first portion 131' and the second portion 132', wherein a protruding structure 140 of the first portion 131' has a first annular structure 141 and a second annular structure 142, the first annular structure 141 and the second annular structure 142 surround the central axis 101, and the second annular structure 142 is located between the first annular structure 141 and a central axis 101. The protruding structure 140 of the first portion 131' matches the concave structure 150 of the second portion 132'. The cross-sections of the first annular structure 141 and the second annular structure 142 are circular.

Figure 4C:
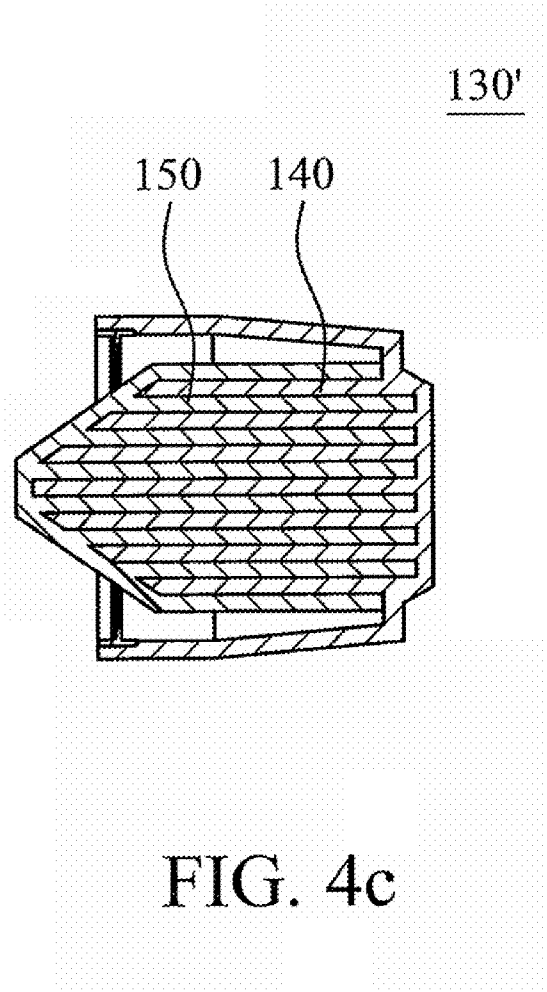
FIG. 4*c* is a cross-sectional view of the dielectric member of the second embodiment of the invention.
Figure 4B:
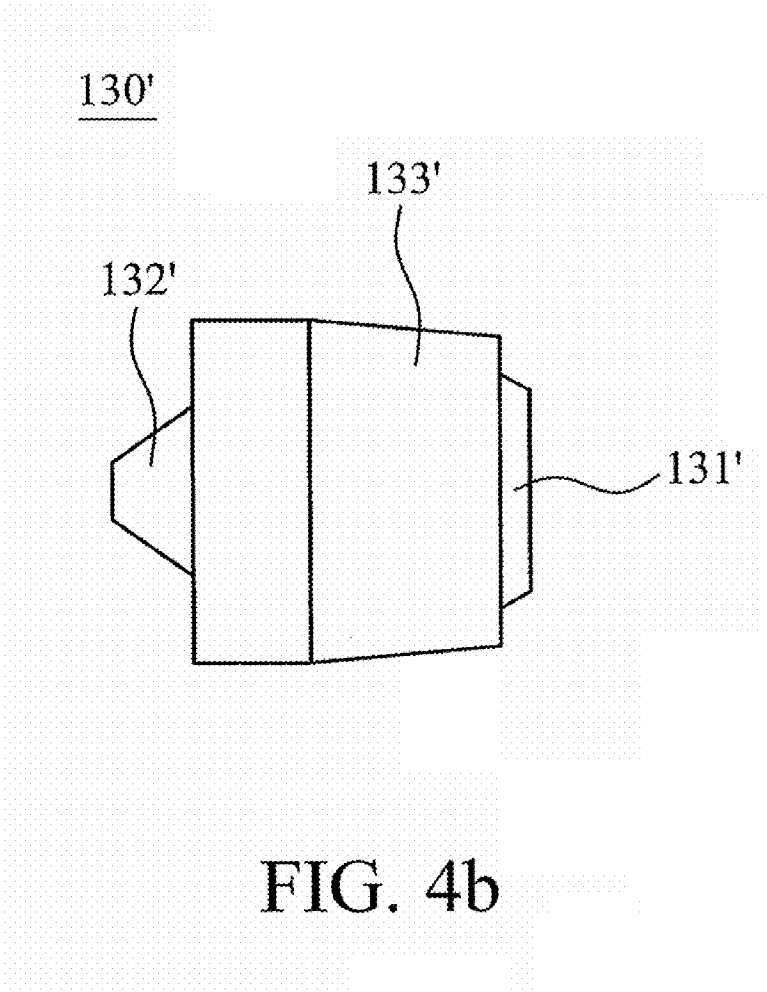
FIG. 4*b* is a side view of the dielectric member of the second embodiment of the invention.

FIG. 4*b* is a side view of the dielectric member 130', and FIG. 4*c* is a cross-sectional view of the dielectric member 130'.

Figure 5B:
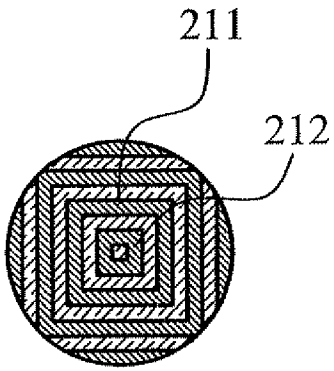
FIG. 5*b* is a cross-sectional view of the dielectric member of FIG. 5*a;*
Figure 5A:
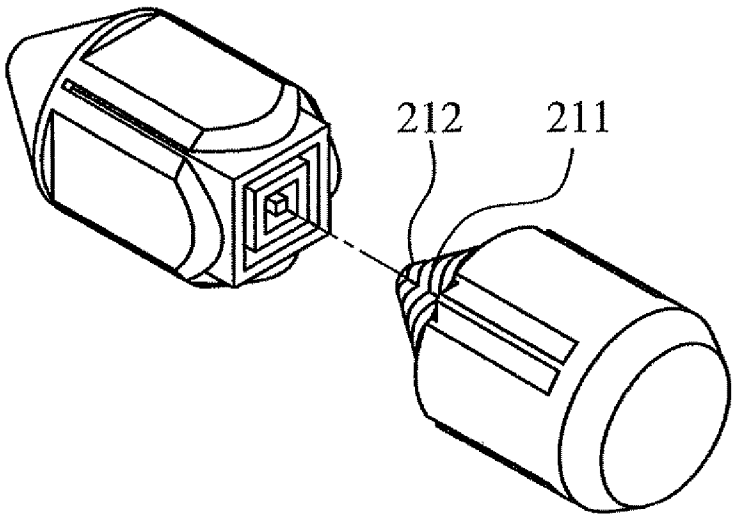
FIG. 5*a* shows a dielectric member of a modified example of the second embodiment of the invention.

FIG. 5*a* shows a dielectric member 210 of a modified example of the second embodiment of the invention. Compared with the second embodiment, the cross-sections of the first annular structure 211 and the second annular structure 212 of the dielectric member 210 are rectangular. FIG. 5*b* is a cross-sectional view of the dielectric member of FIG. 5*a*.

In the embodiments of the invention, the design of the dielectric member can be modified, and several examples are shown as follows.

Figure 6B:
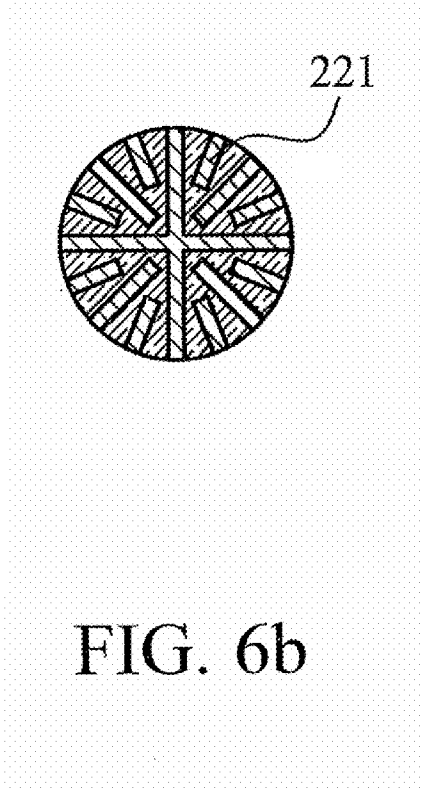
FIG. 6*b* is a cross-sectional view of the dielectric member of FIG. 6*a;*
Figure 6A:
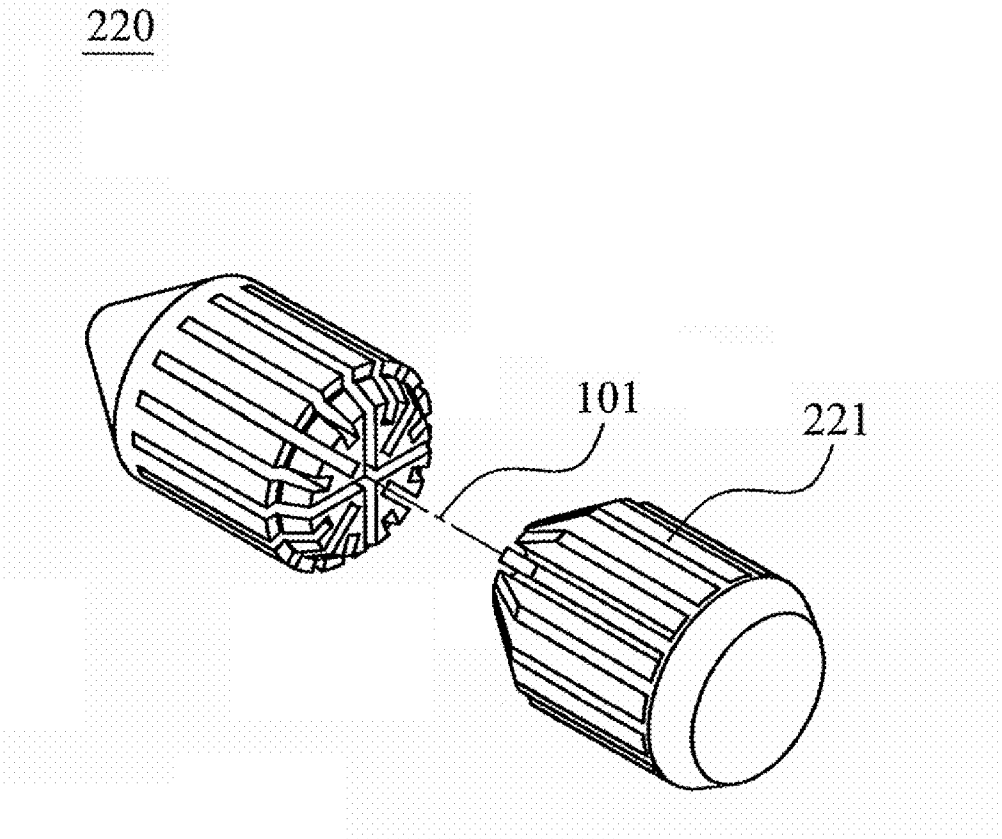
FIG. 6*a* shows a dielectric member of a third embodiment of the invention.

FIGS. 6*a* and 6*b* show a dielectric member 220 of a third embodiment of the invention. FIG. 6*b* is a cross-sectional view of the dielectric member of FIG. 6*a*. In this embodiment the protruding structure of the dielectric member 220 includes a plurality of ribs 221. The ribs 221 surround the central axis 101, and extend in radial directions from the central axis 101. A plurality of slots are formed on a side wall of the protruding structure.

Figure 7B:
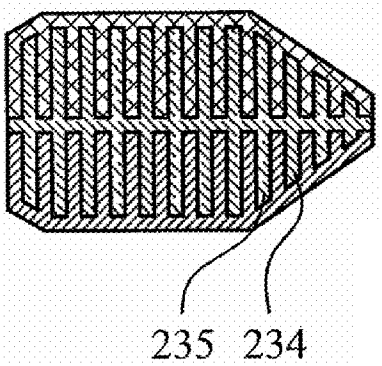
FIG. 7*b* is a cross-sectional view of the dielectric member of FIG. 7*a;*
Figure 7A:
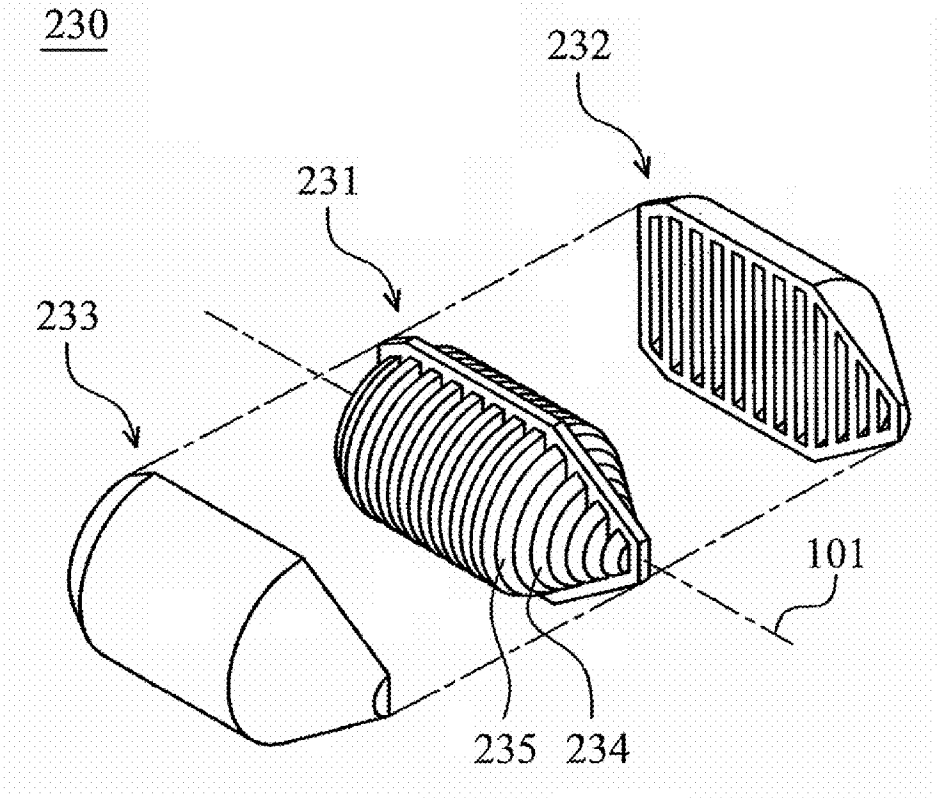
FIG. 7*a* shows a dielectric member of a fourth embodiment of the invention.

FIGS. 7*a* and 7*b* show a dielectric member 230 of a fourth embodiment of the invention. FIG. 7*b* is a cross-sectional view of the dielectric member of FIG. 7*a*. In this embodiment, a first portion 231, a second portion 232 and a third portion 233 is included in the dielectric member 230. The first portion 231 is sandwiched between the second portion 232 and the third portion 233. A protruding structure is formed on the first portion 231, and concave structures are formed on the second portion 232 and the third portion 233. The protruding structure has a first disk 234 and a second disk 235. The central axis 101 passes through the center of the first disk 234 and the second disk 235, and the first disk 234 and the second disk 235 are aligned along the central axis.

Figure 8B:
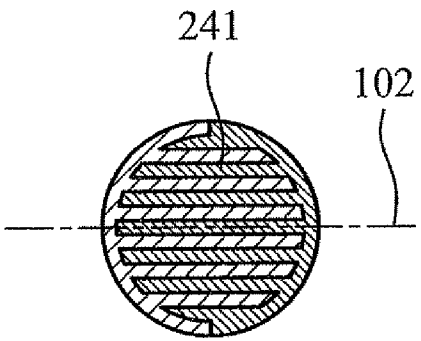
FIG. 8*b* is a cross-sectional view of the dielectric member of FIG. 8*a;*
Figure 8A:
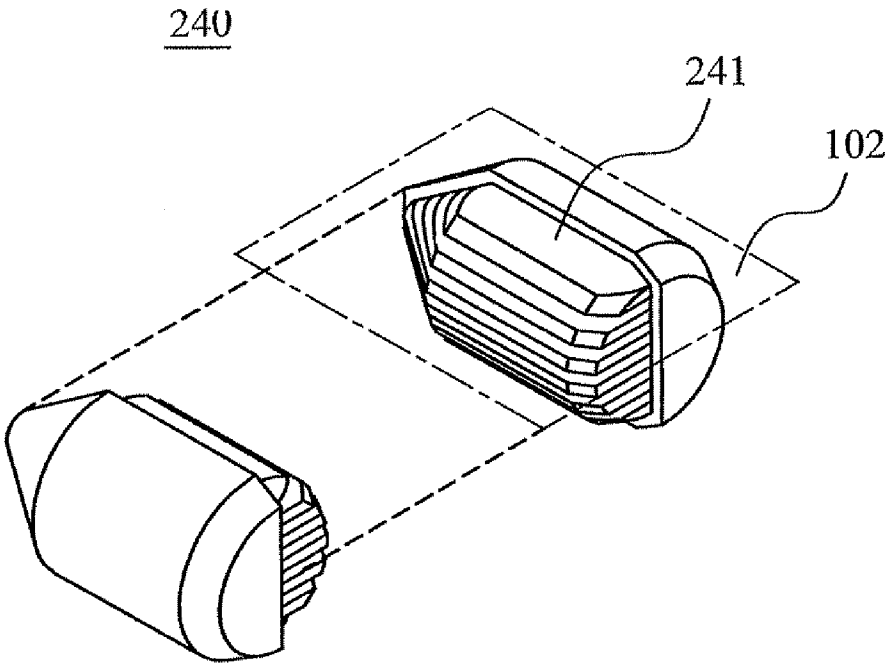
FIG. 8*a* shows a dielectric member of a fifth embodiment of the invention.

FIGS. 8*a* and 8*b* show a dielectric member 240 of a fifth embodiment of the invention. FIG. 8*b* is a cross-sectional view of the dielectric member of FIG. 8*a*. In this embodiment, the protruding structure (241) of the dielectric member 240 is formed symmetric to a central plane (first plane) 102 of the wave guide. The protruding structure (241) has a plurality of planner structures 241, and the planner structures 241 are parallel to the central plane 102, and are arranged symmetric to the central plane 102.

Figure 9B:
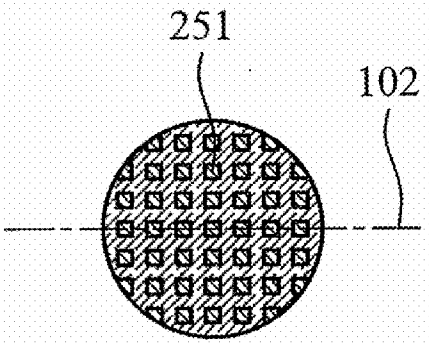
FIG. 9*b* is a cross-sectional view of the dielectric member of FIG. 9*a;*
Figure 9A:
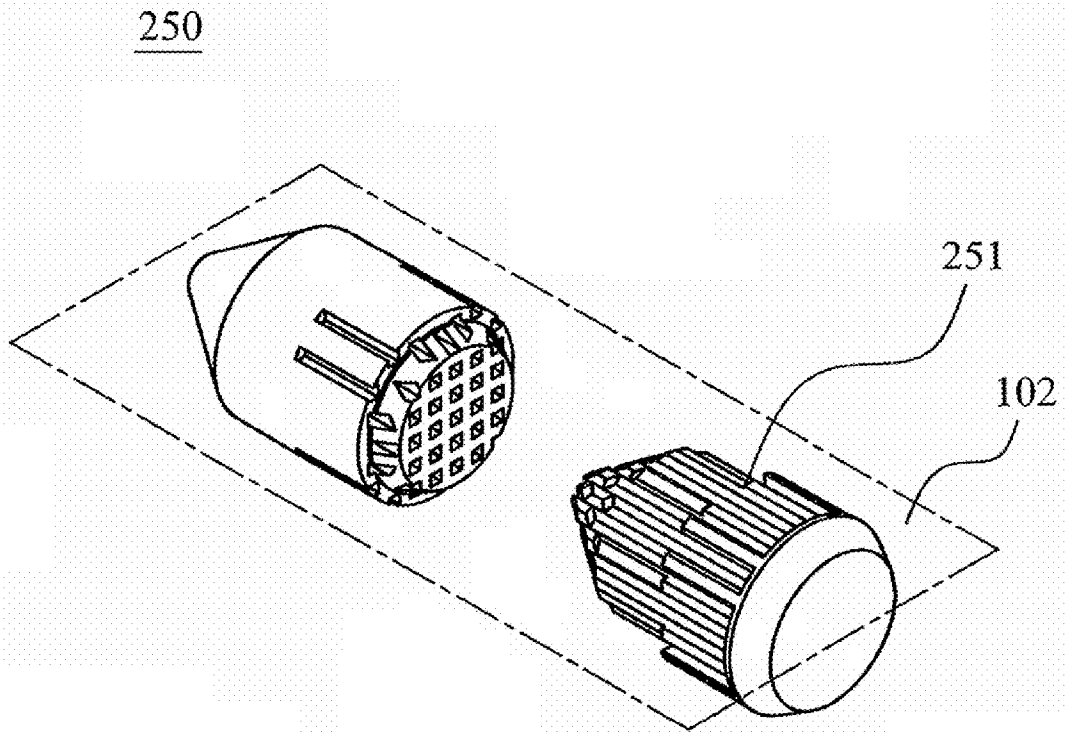
FIG. 9*a* shows a dielectric member of a sixth embodiment of the invention.

FIGS. 9*a* and 9*b* show a dielectric member 250 of a sixth embodiment of the invention. FIG. 9*b* is a cross-sectional view of the dielectric member of FIG. 9*a*. In this embodiment, the protruding structure (251) of the dielectric member 250 is formed symmetric to a central plane 102 of the wave guide. The protruding structure (251) has a plurality of pillars 251, and the pillars 251 are parallel to the central plane 102, and are arranged in matrix symmetric to the central plane 102.

Figure 10A:
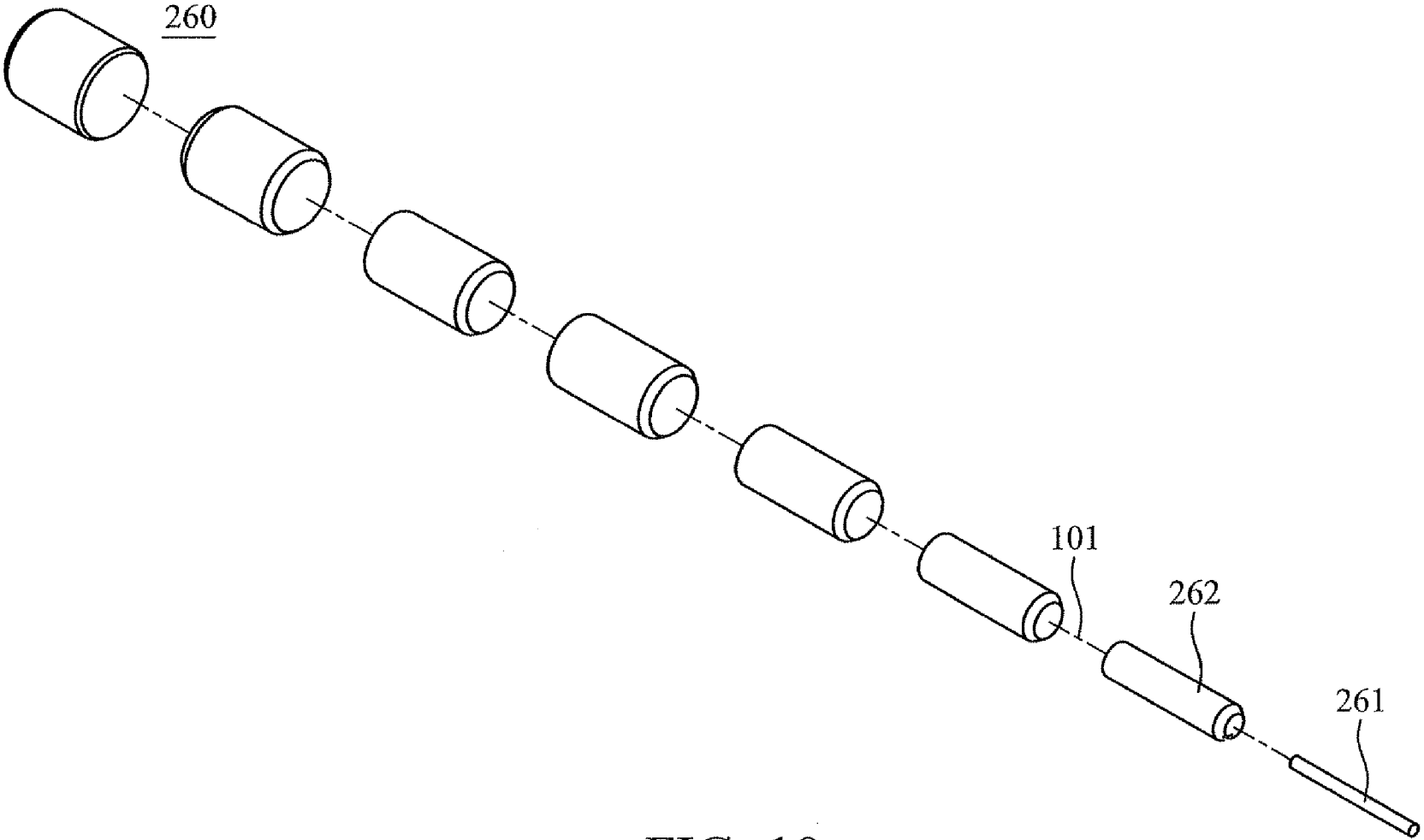
FIG. 10*a* is an exploded view of the seventh embodiment of the invention.
Figure 10C:
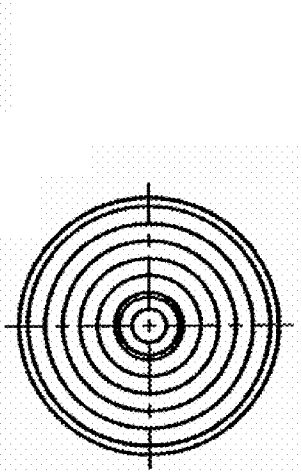
FIG. 10*c* is a front view of the seventh embodiment of the invention.
Figure 10B:
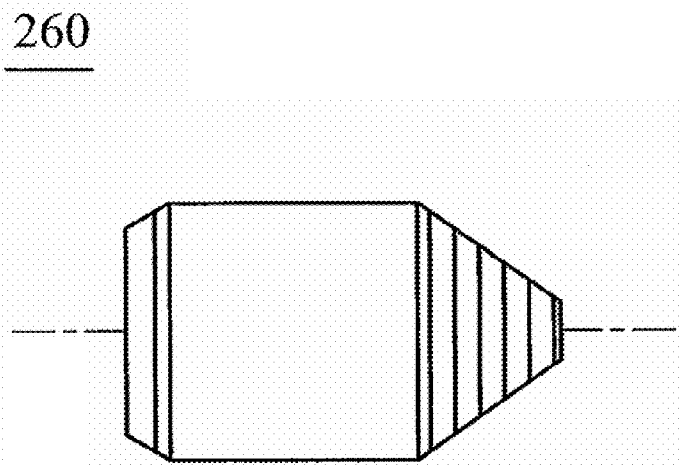
FIG. 10*b* is a side view of the seventh embodiment of the invention.

FIGS. 10*a*, 10*b* and 10*c* show a dielectric member 260 of a seventh embodiment of the invention. FIG. 10*a* is an exploded view of the seventh embodiment, FIG. 10*b* is a side view of the seventh embodiment, and FIG. 10*c* is a front view of the seventh embodiment of the invention. The dielectric member 260 is substantially a pillar, having a first portion 261 and a second portion 262, the first portion 261 is located on a central axis 101 of the wave guide, and the second portion 262 is telescoped on the first portion 261. In this embodiment, the dielectric member is formed by a plurality of telescoping annular structures.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A satellite antenna device, comprising:

a wave guide;

a dielectric member, connected to the wave guide, wherein the dielectric member comprises a first portion and a second portion, the first portion has a protruding structure, the second portion has a concave structure, and the concave structure corresponds to the protruding structure, and is matched therewith, wherein the protruding structure has a first disk and a second disk separated by a gap which is filled by the concave structure, a central axis passes through the center of the first disk and the second disk, and the first disk and the second disk are aligned along the central axis; and a third portion symmetrical to the second portion, wherein the first portion is sandwiched between the second portion and the third portion.

* * * * *